US010878745B2

(12) United States Patent
Park et al.

(10) Patent No.: US 10,878,745 B2
(45) Date of Patent: Dec. 29, 2020

(54) SCAN DRIVER AND DISPLAY DEVICE INCLUDING THE SAME

(71) Applicant: Samsung Display Co., Ltd., Yongin-si (KR)

(72) Inventors: Jun Hyun Park, Yongin-si (KR); Dong Woo Kim, Yongin-si (KR); An Su Lee, Yongin-si (KR); Kang Moon Jo, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/746,401

(22) Filed: Jan. 17, 2020

(65) Prior Publication Data

US 2020/0380911 A1 Dec. 3, 2020

(30) Foreign Application Priority Data

May 28, 2019 (KR) ..... 10-2019-0062602

(51) Int. Cl.

| | |
|---|---|
| ***G09G 3/36*** | (2006.01) |
| ***G09G 5/00*** | (2006.01) |
| ***G09G 3/32*** | (2016.01) |

(52) U.S. Cl.

CPC ..... *G09G 3/32* (2013.01); *G09G 2310/0267* (2013.01); *G09G 2310/0291* (2013.01); *G09G 2310/08* (2013.01)

(58) Field of Classification Search

CPC ... G09G 3/30; G09G 3/36; G09G 5/00; G11C 19/00; G02F 1/1345; G06F 3/038

See application file for complete search history.

(56) References Cited

U.S. PATENT DOCUMENTS

2006/0022201 A1* 2/2006 Kim ..... H01L 29/78669 257/72
2012/0098800 A1* 4/2012 Kim ..... G11C 19/28 345/204

(Continued)

FOREIGN PATENT DOCUMENTS

CN 108648716 A 10/2018
KR 10-2016-0073928 A 6/2016

(Continued)

OTHER PUBLICATIONS

EPO Extended European Search Report dated Aug. 4, 2020, for corresponding European Patent Application No. 20171291.6 (14 pages).

*Primary Examiner* — Pegeman Karimi
(74) *Attorney, Agent, or Firm* — Lewis Roca Rothgerber Christie LLP

(57) ABSTRACT

A scan driver includes stages configured to output a scan signal and a sensing signal, wherein an i-th (where i is an odd number) stage includes a common circuit configured to control voltages of a first node and a second node in response to a previous carry signal, a first carry control clock signal, and a second carry control clock signal, to control a voltage of a sampling node in response to a sensing on signal and a subsequent carry signal, and to control voltages of a first drive node and a second drive node based on the voltages of the first node, the second node, the sampling node, and a sensing clock signal, and a first output buffer configured to output the scan signal and the sensing signal to an i-th pixel row in response to the voltages of the first drive node and the second drive node.

20 Claims, 7 Drawing Sheets

(56) References Cited

U.S. PATENT DOCUMENTS

| | | | | |
|---|---|---|---|---|
| 2014/0146031 | A1* | 5/2014 | Lee | G11C 19/28 345/212 |
| 2016/0247479 | A1 | 8/2016 | Cho et al. | |
| 2018/0337682 | A1* | 11/2018 | Takasugi | G09G 3/3241 |
| 2019/0180691 | A1* | 6/2019 | Takasugi | G09G 3/3233 |
| 2020/0184898 | A1 | 6/2020 | Choi et al. | |
| 2020/0193912 | A1 | 6/2020 | Park et al. | |

FOREIGN PATENT DOCUMENTS

| | | | |
|---|---|---|---|
| KR | 10-2016-0086436 | A | 7/2016 |
| KR | 10-2018-0031879 | A | 3/2018 |
| KR | 10-2018-0036855 | A | 4/2018 |
| KR | 10-2020-0071206 | A | 6/2020 |
| KR | 10-2020-0072635 | A | 6/2020 |

* cited by examiner

SCAN DRIVER AND DISPLAY DEVICE INCLUDING THE SAME

CROSS-REFERENCE TO RELATED APPLICATION

This application claims priority to and the benefit of Korean Patent Application No. 10-2019-0062602, filed on May 28, 2019, the content of which is herein incorporated by reference in its entirety.

BACKGROUND

1. Field

Aspects of the disclosure relate to a display device, and more particularly, to a scan driver and a display device including the same.

2. Description of the Related Art

The display device includes a display panel, a scan driver, a data driver, a timing controller, and the like. The scan driver provides a scan signal to the display panel through scan lines. To this end, the scan driver includes sequentially connected stage circuits for outputting a scan signal. Each of the stage circuits includes a plurality of oxide thin film transistors and is operated.

In recent years, a display device performs driving that compensates deterioration or a characteristic change of a driving transistor outside a pixel circuit by sensing a threshold voltage or mobility of the driving transistor included in a pixel circuit. At this time, a scan method for a display operation, a mobility sensing operation, and a threshold voltage sensing operation are different from each other. Currently, research on a scan driver and a stage circuit thereof for minimizing complexity of a circuit while stably performing such various types of operations is ongoing.

The above information disclosed in this Background section is only for enhancement of understanding of the background of the invention and therefore it may contain information that does not form the prior art.

SUMMARY aspects of embodiments of the disclosure are directed to a scan driver in which a plurality of output buffers are configured to share one drive controller, and a display device including the scan driver.

However, aspects of the disclosure are not limited to the above-described aspects, and may be variously extended without departing from the spirit and scope of the disclosure.

According to some embodiments of the disclosure, there is provided a scan driver including: a plurality of stages configured to output a scan signal and a sensing signal, wherein an i-th (where i is an odd number) stage includes: a common circuit configured to control voltages of a first node and a second node in response to a previous carry signal, a first carry control clock signal, and a second carry control clock signal, to control a voltage of a sampling node in response to a sensing on signal and a subsequent carry signal, and to control voltages of a first drive node and a second drive node based on the voltages of the first node, the second node, the sampling node, and a sensing clock signal; a first output buffer configured to output the scan signal and the sensing signal to an i-th pixel row in response to the voltages of the first drive node and the second drive node;

and a second output buffer configured to output the scan signal and the sensing signal to an (i+1)-th pixel row in response to the voltages of the first drive node and the second drive node.

In some embodiments, the common circuit includes: a first drive controller configured to control the voltages of the first node and the second node in response to the previous carry signal, the first carry control clock signal, and the second carry control clock signal; a second drive controller configured to control the voltage of the sampling node in response to the sensing on signal and the subsequent carry signal and to control the voltages of the first drive node and the second drive node in response to the voltages of the first node, the second node, the sampling node, and the sensing clock signal; a third drive controller configured to output a carry signal in response to the voltage of the first node and the voltage of the second node; and a fourth drive controller configured to electrically connect the first node and the first drive node to each other and electrically connect the second node and the second drive node to each other in response to a display on signal.

In some embodiments, gate on voltage periods of the first carry control clock signal and the second carry control clock signal do not overlap, and a gate on voltage period of the sensing on signal overlaps a portion of the gate on voltage period of the second carry control clock signal.

In some embodiments, the first carry control clock signal is applied prior to the second carry control clock signal.

In some embodiments, the sensing on signal is supplied to at least one stage of the stages in a display period, and wherein the at least one stage is configured to output the scan signal and the sensing signal in response to a scan control clock signal and a sensing control clock signal during a vertical blank period after the display period.

In some embodiments, the sensing scan control clock signal and the sensing control clock signal are supplied to at least one of the first output buffer and the second output buffer in the vertical blank period.

In some embodiments, the first drive controller includes: a fourth transistor connected between a first power terminal to which a first power is supplied and the first node, the fourth transistor having a gate electrode configured to receive the previous carry signal or a scan start signal; a fifth transistor and a sixth transistor connected in series between the first node and a carry output terminal configured to output the carry signal, the fifth transistor having a gate electrode connected to a second carry control clock terminal to which the first carry control clock signal is applied and the sixth transistor having a gate electrode connected to the second node; a ninth transistor connected between the first node and the carry output terminal, the ninth transistor having a gate electrode configured to receive the subsequent carry signal; a third transistor connected between a first carry control clock terminal to which the second carry control clock signal is applied and the second node, the third transistor having a gate electrode connected to the first node; and a seventh transistor connected between the first power terminal and the second node, the seventh transistor having a gate electrode connected to the first carry control clock terminal.

In some embodiments, the third transistor includes first and second sub transistors connected in series between the first carry control clock terminal and the second node, the first and second sub transistors having gate electrodes connected to the first node, and wherein the first drive controller further includes: a twenty-third transistor connected between a common node of the first and second sub transistors and the first power terminal, the twenty-third transistor having a gate electrode connected to the second node.

In some embodiments, the second drive controller includes: a sixteenth transistor connected between an input terminal to which the subsequent carry signal is applied and the sampling node, the sixteenth transistor having a gate electrode configured to receive the sensing on signal; a seventeenth transistor connected between a third node and the first drive node, the seventeenth transistor having a gate electrode connected to a sensing node; an eighteenth transistor connected between a first sensing clock terminal to which a first sensing clock signal is applied and the third node, the eighteenth transistor having a gate electrode configured to receive a second sensing clock signal; and a nineteenth transistor diode-connected between a carry output terminal from which the carry signal is output and the third node.

In some embodiments, the sixteenth transistor includes first and second sub transistors connected in series between the input terminal to which the subsequent carry signal is applied and the sampling node, the first and second sub transistors having gate electrodes configured to receive the sensing on signal, and wherein the second drive controller further includes: a twenty-second transistor connected between a common node of the first and second sub transistors and a first power terminal, the twenty-second transistor having a gate electrode connected to the sampling node.

In some embodiments, the second drive controller includes: fourteenth and fifteenth transistors connected in series between a third power terminal to which a third power is applied and the second drive node, the fourteenth and fifteenth transistors having gate electrodes connected to the sampling node and the first drive node, respectively; and a twenty-fourth transistor connected between a common node of the fourteenth and fifteenth transistors and a first power terminal to which first power is supplied, the twenty-fourth transistor having a gate electrode connected to the second drive node.

In some embodiments, the second drive controller further includes: twenty-fifth and twenty-sixth transistors connected in series between the carry output terminal and the first drive node, the twenty-fifth and twenty-sixth transistors having gate electrodes connected to a third sensing clock terminal to which a third sensing clock signal is applied and the second drive node, respectively.

In some embodiments, the third drive controller includes: a tenth transistor connected between a second carry control clock terminal to which the first carry control clock signal is applied and a carry output terminal from which the carry signal is output, the tenth transistor having a gate electrode connected to the first node; and an eleventh transistor connected between the carry output terminal and a second power terminal to which second power is applied, the eleventh transistor having a gate electrode connected to the second node.

In some embodiments, the fourth drive controller includes: a twelfth transistor connected between the first node and the first drive node, the twelfth transistor having a gate electrode configured to receive the display on signal; and a thirteenth transistor connected between the second node and the second drive node, the thirteenth transistor having a gate electrode configured to receive the display on signal.

In some embodiments, the first output buffer includes: a first transistor connected between a first scan control clock terminal to which a first scan control clock signal is applied and a first output terminal configured to output the scan signal, the first transistor having a gate electrode connected to the first drive node; a second transistor connected between a third power terminal to which a third power is applied and the first output terminal, the second transistor having a gate electrode connected to the second drive node; a twentieth transistor connected between a first sensing control clock terminal to which a first sensing control clock signal is applied and a second output terminal configured to output the sensing signal, the twentieth transistor having a gate electrode connected to the first drive node; and a twenty-first transistor connected between the third power terminal and the second output terminal, the twenty-first transistor having a gate electrode connected to the second drive node.

In some embodiments, the second output buffer includes: a twenty-seventh transistor connected between a second scan control clock terminal to which a second scan control clock signal is applied and a third output terminal configured to output the scan signal, the twenty-seventh transistor having a gate electrode connected to the first drive node; a twenty-eighth transistor connected between a third power terminal to which a third power is applied and the third output terminal, the twenty-eighth transistor having a gate electrode connected to the second drive node; a twenty-ninth transistor connected between a second sensing control clock terminal to which a second sensing control clock signal is applied and a fourth output terminal outputting the sensing signal, the twenty-ninth transistor having a gate electrode connected to the first drive node; and a thirtieth transistor connected between the third power terminal and the fourth output terminal, the thirtieth transistor having a gate electrode connected to the second drive node.

In some embodiments, the first drive controller includes: a fourth transistor connected between a first power terminal to which a first power is applied and the first node, the fourth transistor having a gate electrode configured to receive the previous carry signal or a scan start signal; fifth and sixth transistors connected in series between the first node and a carry output terminal configured to output the carry signal, the fifth and sixth transistors having gate electrodes connected to a first scan control clock terminal to which a first scan control clock signal is applied and the second node, respectively; a thirty-first transistor connected between the first node and a common node of the fifth and sixth transistors, the thirty-first transistor having a gate electrode connected to a second scan control clock terminal to which a second scan control clock signal is applied; a ninth transistor connected between the first node and the carry output terminal, the ninth transistor having a gate electrode configured to receive the subsequent carry signal; a third transistor connected between a first carry control clock terminal to which a second carry control clock signal is applied and the second node, the third transistor having a gate electrode connected to the first node; and a seventh transistor connected between the first power terminal and the second node, the seventh transistor having a gate electrode connected to the first carry control clock terminal.

According to some embodiments of the disclosure, there is provided a display device including: a plurality of pixels connected to first and second scan lines and data lines, respectively; a scan driver including a plurality of stages to supply a scan signal and a sensing signal to each of the first and second scan lines; and a data driver configured to supply a data signal to the data lines, wherein an i-th (where i is an odd number) stage includes: a common circuit configured to control voltages of a first node and a second node in response to a previous carry signal, a first carry control clock signal, and a second carry control clock signal, to control a voltage of a sampling node in response to a sensing on signal and a subsequent carry signal, and to control voltages of a first drive node and a second drive node based on the voltages of the first node, the second node, and the sampling node, and a sensing clock signal; a first output buffer configured to output the scan signal and the sensing signal to an i-th pixel row in response to the voltages of the first drive node and the second drive node; and a second output buffer configured to output the scan signal and the sensing signal to an (i+1)-th pixel row in response to the voltages of the first drive node and the second drive node.

In some embodiments, the common circuit includes: a first drive controller configured to control the voltages of the first node and the second node in response to the previous carry signal, the first carry control clock signal, and the second carry control clock signal; a second drive controller configured to control the voltage of the sampling node in response to the sensing on signal and the subsequent carry signal and control the voltages of the first drive node and the second drive node in response to the voltages of the first node, the second node, and the sampling node, and the sensing clock signal; a third drive controller configured to output a carry signal in response to the voltage of the first node and the voltage of the second node; and a fourth drive controller configured to electrically connect the first node and the first drive node to each other and electrically connect the second node and the second drive node to each other in response to a display on signal.

In some embodiments, gate on voltage periods of the first carry control clock signal and the second carry control clock signal do not overlap, and wherein a gate on voltage period of the sensing on signal overlaps a portion of the gate on voltage period of the second carry control clock signal.

However, the embodiments of the disclosure are not limited to the embodiments described above, and may be variously extended without departing from the spirit and scope of the disclosure.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
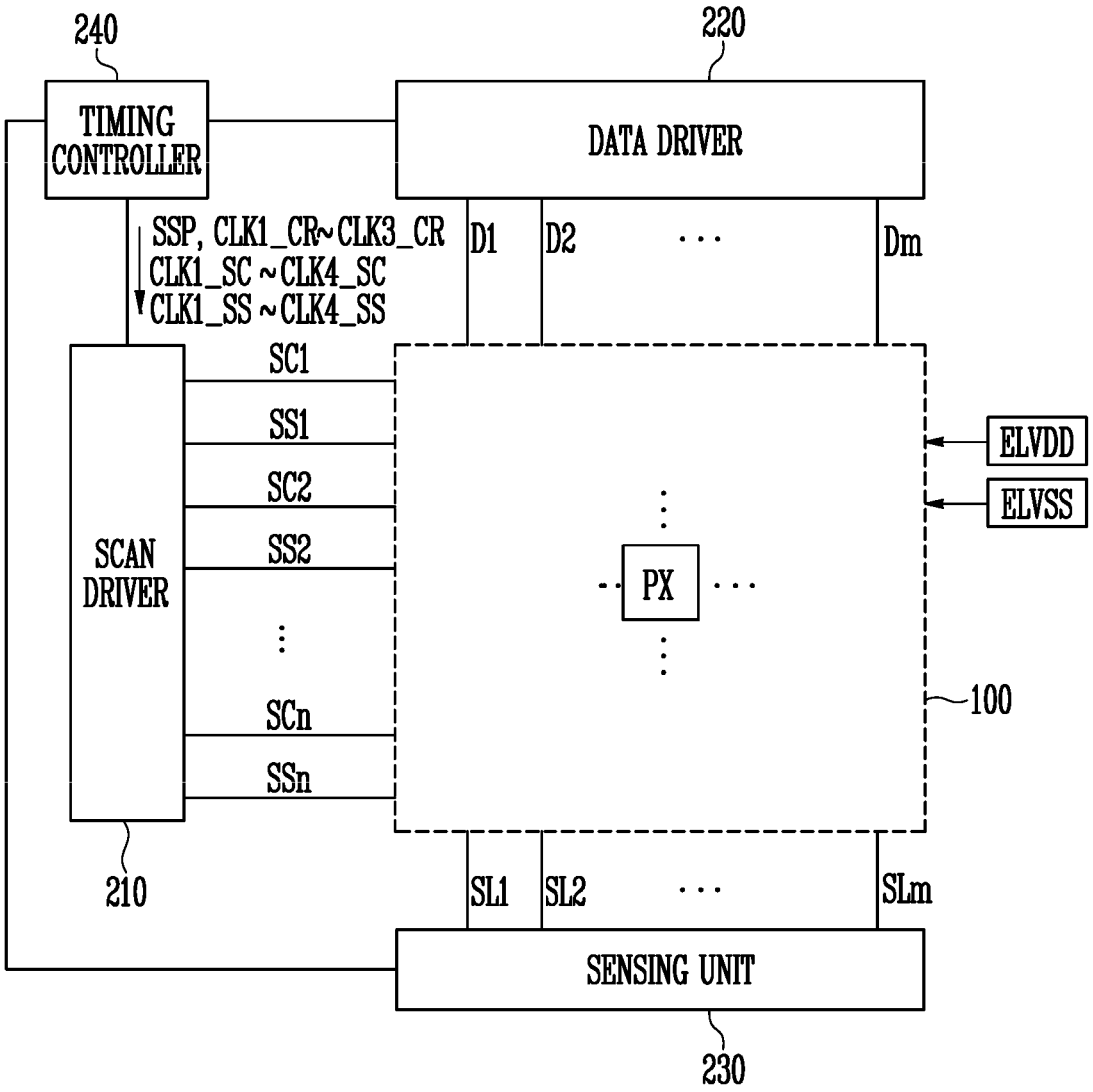
FIG. 1 is a diagram illustrating a display device according to an example embodiment of the disclosure.

Hereinafter, preferred embodiments of the disclosure will be described in more detail with reference to the accompanying drawings. The same reference numerals are used for the same components in the drawings and repetitive descriptions for the same components are omitted.

FIG. 1 is a diagram illustrating a display device according to an embodiment of the disclosure.

Referring to FIG. 1, the display device according to an embodiment of the disclosure may include a display unit 100 including a plurality of pixels PX, a scan driver 210, a data driver 220, a sensing unit 230, and a timing controller 240.

The timing controller 240 may generate a scan drive control signal and a data drive control signal based on externally input signals. The scan drive control signal generated by the timing controller 240 may be supplied to the scan driver 210 and the data drive control signal may be supplied to the data driver 220.

The scan drive control signal may include a plurality of clock signals CLK1_CR to CLK3_CR, CLK1_SC to CLK4_SC, and CLK1_SS to CLK4_SS and a scan start signal SSP. The scan start signal SSP may control an output timing of a first scan signal.

The plurality of clock signals CLK1_CR to CLK3_CR, CLK1_SC to CLK4_SC, and CLK1_SS to CLK4_SS supplied to the scan driver 210 may include first to third carry control clock signals CLK1_CR to CLK3_CR, first to fourth scan control clock signals CLK1_SC to CLK4_SC, and first to fourth sensing control clock signals CLK1_SS to CLK4_SS. The first to third carry control clock signals CLK1_CR to CLK3_CR may be used to shift the scan start signal SSP. The first to fourth scan control clock signals CLK1_SC to CLK4_SC may be used to output a scan signal corresponding to at least one of the scan start signal SSP and the first to third carry control clock signals CLK1_CR to CLK3_CR. The first to fourth sensing control clock signals CLK1_SS to CLK4_SS may be used to output a sensing signal corresponding to at least one of the scan start signal SSP and the first to third carry control clock signals CLK1_CR to CLK3_CR. In addition, the scan driver 210 may receive a clock signal other than the clock signals CLK1_CR to CLK3_CR, CLK1_SC to CLK4_SC, and CLK1_SS to CLK4_SS described above.

The data drive control signal may include a source start pulse and clock signals. The source start pulse may control a sampling start time of data, and the clock signals may be used to control a sampling operation.

The scan driver 210 may output the scan signals corresponding to the scan drive control signal. The scan driver 210 may sequentially supply the scan signals to first scan lines SC1 to SCn. Here, the scan signal may be set to a gate on voltage (e.g., a voltage of a high level) so that transistors included in the pixels PX may be turned on.

The scan driver 210 may output the sensing signals corresponding to the scan drive control signal. The scan driver 210 may supply a second scan signal to at least one second scan line of second scan lines SS1 to SS2. Here, the second scan signal may be set to a gate on voltage (e.g., a voltage of a high level) so that the transistors included in the pixels PX may be turned on. In the following embodiments, the second scan signal may be referred to as the sensing signal output from the scan driver 210.

The data driver 220 may supply data signals to data lines D1 to Dm corresponding to the data drive control signal. The data signals supplied to the data lines D1 to Dm may be supplied to the pixels PX to which the scan signals are supplied. To this end, the data driver 220 may supply the data signals to the data lines D1 to Dm in synchronization with the scan signal.

The sensing unit 230 may supply an initialization power to the pixels to which the sensing signal is supplied to the sensing lines SL1 to SLm and may measure deterioration information of the pixels. Although the sensing unit 230 is shown as a separate configuration in FIG. 1, the sensing unit 230 may be included in the data driver 220.

The display unit 100 may include the plurality of pixels PX connected to the data lines D1 to Dm, the first scan lines SC1 to SCn, the second scan lines SS1 to SSn, and the sensing lines SL1 to SLm.

The pixels PX may receive first driving power ELVDD and second driving power ELVSS from the outside. Each of the pixels PX may receive the data signal from the data lines D1 to Dm when the scan signal is supplied to the first scan lines SC1 to SCn connected thereto. The pixel PX receiving the data signal may control an amount of current flowing from the first driving power ELVDD to the second driving power ELVSS via a light emitting element corresponding to the data signal. At this time, the light emitting element may generate light of a set or predetermined luminance corresponding to the amount of current. In addition, the first driving power ELVDD may be set to a voltage higher than the second driving power ELVSS.

In some cases, the pixel PX may be connected to a light emission control line in addition to the first scan lines SC1 to SCn, the second scan lines SS1 to SSn, and the data lines D1 to Dm. In this case, a light emission driver for outputting a light emission control signal may further be provided.

Figure 2:
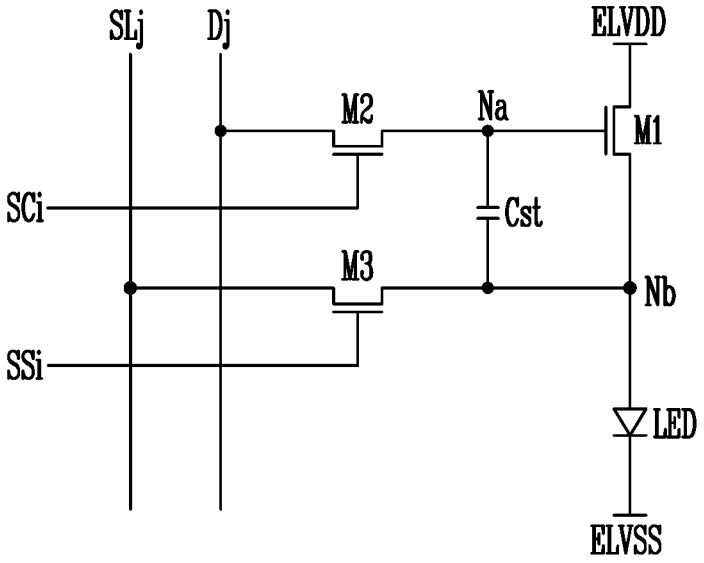
FIG. 2 is a diagram illustrating a pixel shown in FIG. 1.

FIG. 2 is a diagram illustrating the pixel shown in FIG. 1. In FIG. 2, for convenience of description, a pixel PX connected to an i-th first scan line SCi, an i-th second scan line SSi, a j-th sensing line SLj, and a j-th data line Dj is shown.

The pixel PX may include a driving transistor M1, a switching transistor M2, a sensing transistor M3, a storage capacitor Cst, and a light emitting element LED.

The switching transistor M2 may include a first electrode connected to the data line Dj, a gate electrode connected to the first scan line SCi, and a second electrode connected to a first node Na. The switching transistor M2 may be turned on when the scan signal is supplied from the first scan line SCi to supply the data signal received from the data line Dj to the storage capacitor Cst. For example, a potential of the first node Na may be controlled. At this time, the storage capacitor Cst including a first electrode connected to the first node Na and a second electrode connected to a second node Nb may charge a voltage corresponding to the data signal.

The driving transistor M1 may include a first electrode connected to the first driving power ELVDD, a second electrode connected to the light emitting element LED, and a gate electrode connected to the first node Na. The driving transistor M1 may control the amount of current flowing in the light emitting element LED in correspondence with a gate-source voltage value.

The sensing transistor M3 may include a first electrode connected to the sensing line SLj, a second electrode connected to the second node Nb, and a gate electrode connected to the second scan line SSi. The sensing transistor M3 may be turned on when the sensing signal is supplied to the second scan line SSi to control a potential of the second node Nb. For example, when the sensing signal is supplied to the second scan line SSi, the sensing transistor M3 may be turned on to measure the current flowing through the light emitting element LED.

The light emitting element LED may include a first electrode (e.g., an anode electrode) connected to the second electrode of the driving transistor M1 and a second electrode (e.g., a cathode electrode) connected to the second driving power ELVSS. The light emitting element LED may generate light corresponding to the amount of current supplied from the driving transistor M1.

In FIG. 2, the first electrode of the transistors M1 to M3 may be set to one of a source electrode and a drain electrode, and the second electrode of the transistors M1 to M3 may be set to an electrode different from the first electrode. For example, when the first electrode is set as the source electrode, the second electrode may be set as the drain electrode.

In addition, the transistors M1 to M3 may be NMOS transistors as shown in FIG. 2, but are not limited thereto. For example, in a modified embodiment, the transistors M1 to M3 may be PMOS transistors.

In an embodiment, while sensing a mobility of the driving transistor M1, an activated scan signal is supplied to the first scan line SCi and an activated sensing signal is supplied to the second scan line SSi. In addition, while sensing the current flowing through the light emitting element LED, a deactivated scan signal may be applied to the first scan line SCi and an activated scan signal may be applied to the second scan line SSi. To sense various pieces of information for the pixel PX as described above, the scan signal supplied to the first scan line SCi and the sensing signal supplied to the second scan line SSi may be separately supplied.

Figure 3:
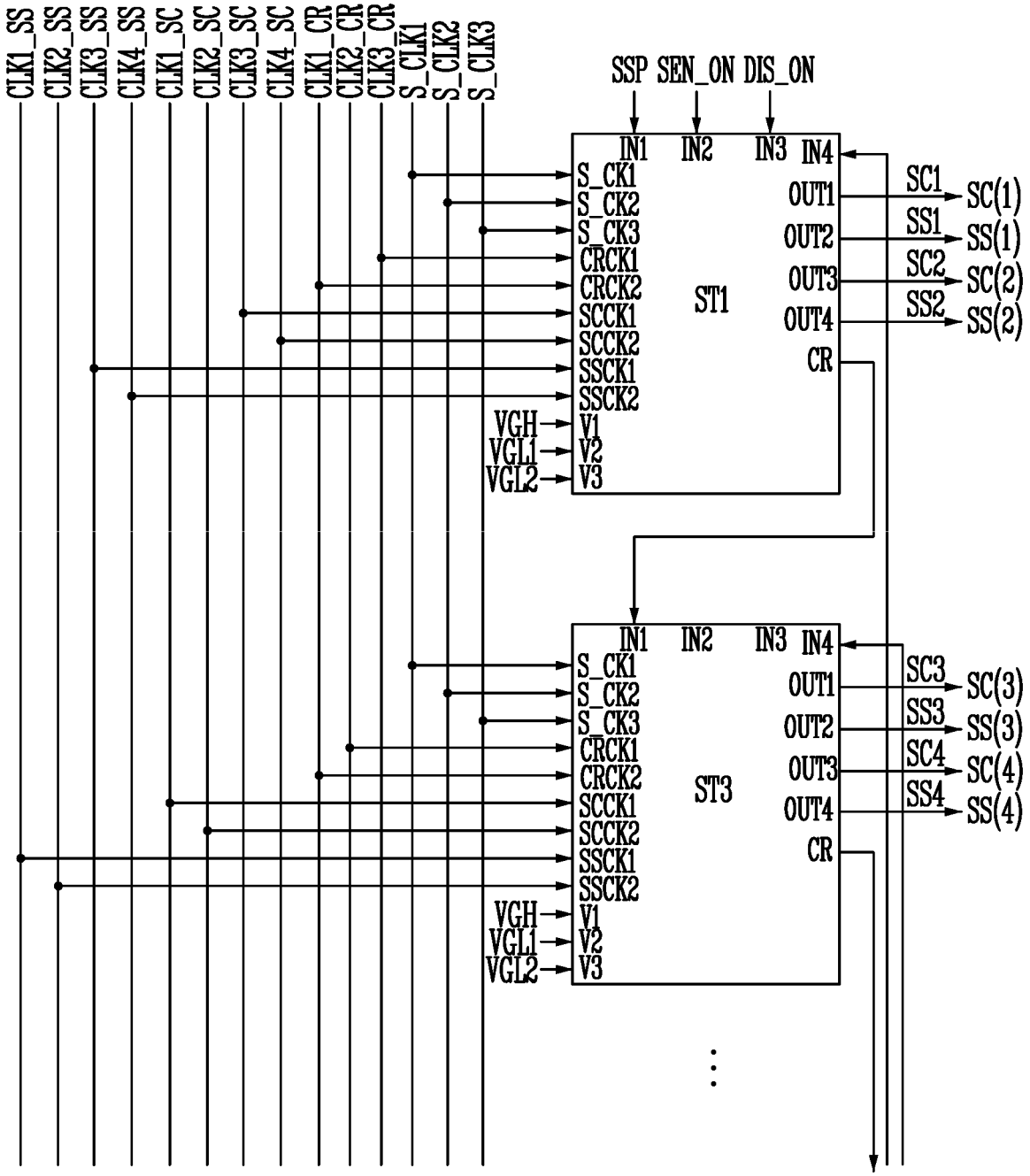
FIG. 3 is a diagram illustrating a scan driver according to an example embodiment of the disclosure.

FIG. 3 is a diagram illustrating a scan driver according to an embodiment of the disclosure.

Referring to FIG. 3, the scan driver 210 may include a plurality of stages ST1, ST3, . . . , etc.

Each of the stages ST1, ST3, . . . may supply scan signals SC(1), SC(2), SC(3), SC(4), . . . to first scan lines SC1, SC2, SC3, SC4, . . . and may supply sensing signals SS(1), SS(2), SS(3), SS(4), . . . to second scan lines SS1, SS2, SS3, SS4, . . . . in response to the scan start signal SSP. For example, an i-th stage may output an i-th scan signal and an (i+1)-th scan signal to an i-th first scan line and an (i+1)-th first scan line, respectively, and may output an i-th sensing signal and an (i+1)-th sensing signal to an i-th second scan line and an (i+1)-th second scan line, respectively. Here, i may be an odd number equal to or greater than 1. The scan start signal SSP for controlling a timing of a first scan signal may be supplied to the first stage ST1.

Each of the stages ST1, ST3, . . . may include a first input terminal IN1, a second input terminal IN2, a third input terminal IN3, a fourth input terminal IN4, a first sensing clock terminal S_CK1, a second sensing clock terminal S_CK2, a third sensing clock terminal S_CK3, a first carry control clock terminal CRCK1, a second carry control clock terminal CRCK2, a first sensing control clock terminal SSCK1, a second sensing control clock terminal SSCK2, a first scan control clock terminal SCCK1, a second scan control clock terminal SCCK2, a first power terminal V1, a second power terminal V2, a third power terminal V3, a carry output terminal CR, and first to fourth output terminals OUT1 to OUT4.

The first input terminal IN1 may receive the scan start signal SSP or a previous carry signal. In an embodiment, the scan start signal SSP may be supplied to the first input terminal IN1 of the first stage ST1 and a carry signal of a previous stage may be applied to each of the first input terminals IN1 of the stages other than the first stage ST1. In an embodiment, a (j−2)-th carry signal (j is an odd number equal to or greater than 3) may be applied to the first input terminal IN1 of a j-th stage.

The second input terminal IN2 may receive a sensing on signal SEN_ON. The sensing on signal SEN_ON is a control signal for outputting the scan signal during a sensing period in which the mobility and a threshold voltage of the driving transistor M1 included in the pixel, and a current characteristic of the light emitting element LED may be sensed. For example, a gate on voltage may be stored in a sampling node included in the stage by the sensing on signal SEN_ON. In an embodiment, the sensing period may be included in a vertical blank period within one frame. In some embodiments of the disclosure, a gate on voltage period of the sensing on signal SEN_ON may be longer than one horizontal period (1H) and shorter than two horizontal periods (2H).

The third input terminal IN3 may receive a display on signal DIS_ON. The display on signal DIS_ON may have a gate on voltage in a display period in one frame and a gate off voltage in the sensing period.

The fourth input terminal IN4 may receive a subsequent carry signal. The subsequent carry signal may be one of the carry signals supplied after a set or predetermined time after an output of the carry signal of a current stage. In an embodiment, an (i+2)-th carry signal may be applied to the fourth input terminal IN4 of the i-th stage.

The first sensing clock terminal S_CK1, the second sensing clock terminal S_CK2, and the third sensing clock terminal S_CK3 may receive a first sensing clock signal S_CLK1, a second sensing clock signal S_CLK2, and a third sensing clock signal S_CLK3, respectively. The first sensing clock signal S_CLK1, the second sensing clock signal S_CLK2, and the third sensing clock signal S_CLK3 may have a gate on voltage during the sensing period and may charge the gate on voltage to a first drive node. In an embodiment, a gate off voltage of the first sensing clock signal S_CLK1, the second sensing clock signal S_CLK2, and the third sensing clock signal S_CLK3 may be set to be lower than a gate off voltage of other signals. For example, the gate off voltage of the first sensing clock signal S_CLK1, the second sensing clock signal S_CLK2, and the third sensing clock signal S_CLK3 may be set to about −15 V.

Any one carry control clock signal of the first to third carry control clock signals CLK1_CR to CLK3_CR may be applied to the first and second carry control clock terminals CRCK1 and CRCK2 of the i-th stage. In an embodiment, when the third carry control clock signal CLK3_CR is input to the first carry control clock terminal CRCK1 of the i-th stage and the first carry control clock signal CLK1_CR is input to the second carry control clock terminal CRCK2 of the i-th stage, the second carry control clock signal CLK2_CR may be input to the first carry control clock terminal CRCK1 of the (i+2)-th stage and the first carry control clock signal CLK1_CR may be input to the second carry control clock terminal CRCK2 of the (i+2)-th stage. In such an embodiment, the first carry control clock signal CLK1_CR and the third carry control clock signal CLK3_CR may be signals with a ⅓ period difference, and the third carry control clock signal CLK3_CR and the second carry control clock signal CLK2_CR may be signals with a ⅓ period difference.

In an embodiment, a gate on voltage period of the carry control clock signals CLK1_CR to CLK3_CR may be two horizontal periods (2H), and a gate off voltage period of the carry control clock signals CLK1_CR to CLK3_CR may be six horizontal periods (6H). In addition, the gate on voltage period of the first carry control clock signal CLK1_CR and the gate on voltage period of the third carry control clock signal CLK3_CR may not overlap each other. In addition, the gate on voltage period of the third carry control clock signal CLK3_CR and the gate on voltage period of the second carry control clock signal CLK2_CR may not overlap each other. Similarly, the gate on voltage period of the second carry control clock signal CLK2_CR and the gate on voltage period of the first carry control clock signal CLK1_CR may not overlap each other.

In some embodiments of the disclosure, at least a portion of the gate on voltage period of the carry control clock signal input to the first carry control clock terminal CRCK1 may overlap the gate on voltage period of the sensing on signal SEN_ON.

The first to third carry control clock signals CLK1_CR to CLK3_CR may be set to a square wave signal that repeats a logic high level and a logic low level. In an embodiment, the first to third carry control clock signals CLK1_CR to CLK3_CR may be a square wave signal of which a duty ratio is 33%. Here, the logic high level may correspond to the gate on voltage, and the logic low level may correspond to the gate off voltage.

The first and second sensing control clock terminals SSCK1 and SSCK2 may receive any one of the sensing control clock signals CLK1_SS to CLK4_SS. For example, when the first sensing control clock terminal SSCK1 receives the first sensing control clock signal CLK1_SS, the second sensing control clock terminal SSCK2 may receive the second sensing control clock signal CLK2_SS, and when the first sensing control clock terminal SSCK1 receives the third sensing control clock signal CLK3_SS, the second sensing control clock terminal SSCK2 may receive the fourth sensing control clock signal CLK4_SS. The sensing control clock signals CLK1_SS to CLK4_SS may have the gate on voltage during the sensing period. The sensing control clock signals CLK1_SS to CLK4_SS may have the gate on voltage that is synchronized with an output of the sensing signals SS(1), SS(2), SS(3), SS(4), . . . .

In an embodiment, the gate on voltage period of the sensing control clock signals CLK1_SS to CLK4_SS may be two horizontal periods (2H). In addition, the gate on voltage period of the first sensing control clock signal CLK1_SS and the gate on voltage period of the second sensing control clock signal CLK2_SS may overlap during a ¼ horizontal period (1/4H). However, this is an example, and a waveform relationship of the sensing control clock signals CLK1_SS to CLK4_SS is not limited thereto.

The first and second scan control clock terminals SCCK1 and SCCK2 may receive any one of the scan control clock signals CLK1_SC to CLK4_SC. For example, when the first scan control clock terminal SCCK1 receives the first scan control clock signal CLK1_SC, the second scan control clock terminal SCCK2 may receive the second scan control clock signal CLK2_SC, and when the first scan control clock terminal SCCK1 receives the third scan control clock signal CLK3_SC, the second scan control clock terminal SCCK2 may receive the fourth scan control clock signal CLK4_SC.

The scan control clock signals CLK1_SC to CLK4_SC may have the gate on voltage during the sensing period. The scan control clock signals CLK1_SC to CLK4_SC may have the gate on voltage that is synchronized with an output of the scan signals SC(1), SC(2), SC(3), SC(4), . . . . In an embodiment, the scan control clock signals CLK1_SC to CLK4_SC may be configured to have a difference of half a period or more.

In an embodiment, the gate on voltage period of the first to fourth scan control clock signals CLK1_SC to CLK4_SC may be two horizontal periods (2H). In addition, the gate on voltage period of the first scan control clock signal CLK1_SC and the gate on voltage period of the second scan control clock signal CLK2_SC may overlap during a ¼ horizontal period (1/4H). However, this is an example, and a waveform relationship of the scan control clock signals CLK1_SC to CLK4_SC is not limited thereto.

The first power terminal V1 may receive a voltage of first power VGH, the second power terminal V2 may receive a voltage of second power VGL1, and the third power terminal V3 may receive a voltage of third power VGL2. In an embodiment, the second power VGL1 and the third power VGL2 may be the same. In addition, in an embodiment, a voltage level of the second power VGL1 may be less than a voltage level of the third power VGL2. For example, the second power VGL1 may be set to about −9 V, and the third power VGL2 may be set to about −6 V.

The carry output terminal CR may output a carry signal. A first output terminal OUT1 may output scan signals SC(1), SC(3), . . . to i-th first scan lines SC1, SC3, . . . . A second output terminal OUT2 may output sensing signals SS(1), SS(3), to i-th second scan lines SS1, SS3, . . . . A third output terminal OUT3 may output scan signals SC(2), SC(4), . . . to (i+1)-th first scan lines SC2, SC4, . . . . A fourth output terminal OUT4 may output sensing signals SS(2), SS(4), . . . to (i+1)-th second scan lines SS2, SS4, . . . .

Figure 4:
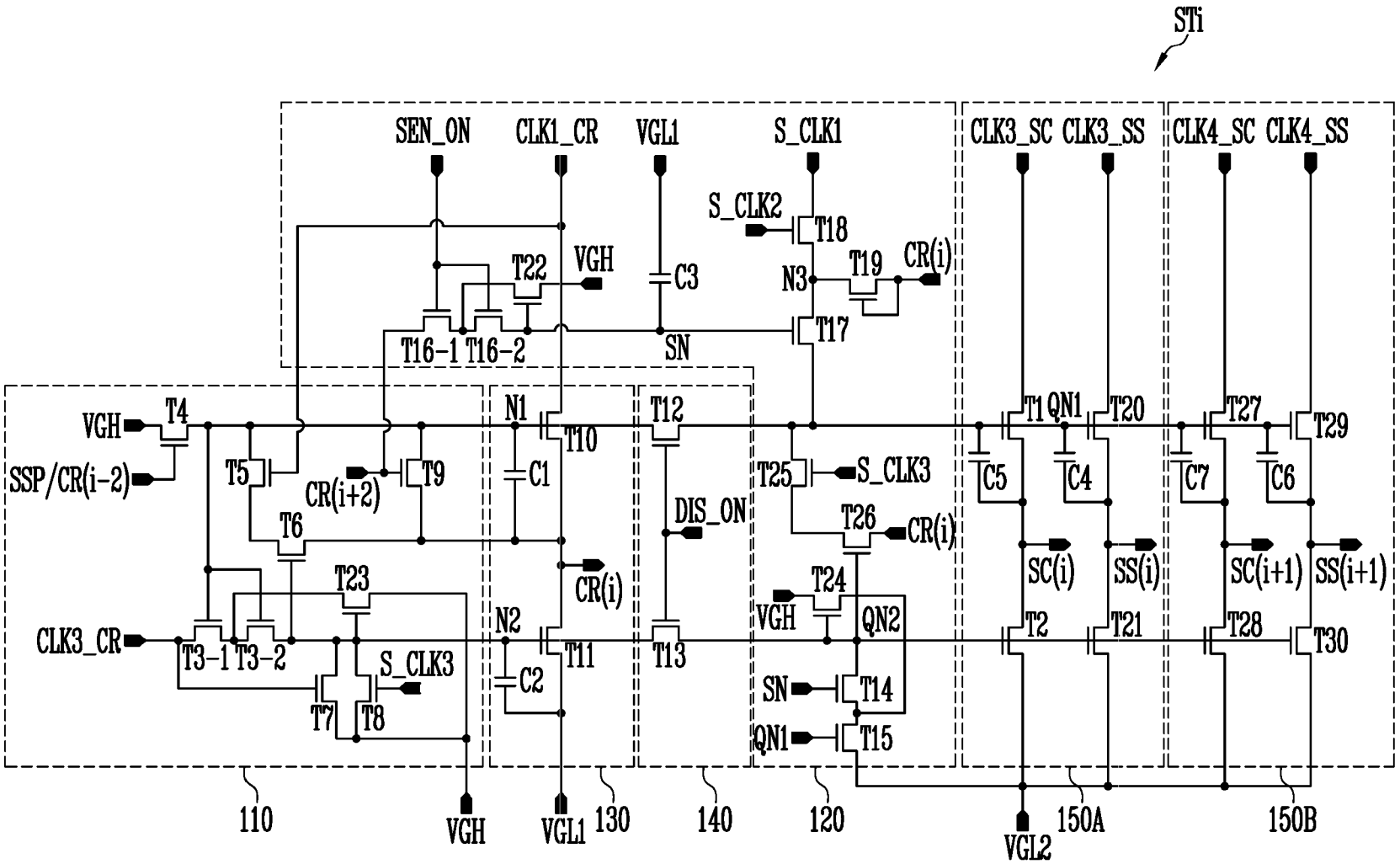
FIG. 4 is a circuit diagram illustrating a first embodiment of a stage included in the scan driver of FIG. 3.

FIG. 4 is a circuit diagram illustrating a first embodiment of a stage included in the scan driver of FIG. 3.

Referring to FIGS. 1 to 4, an i-th stage STi (here, i is an odd number equal to or greater than 1) may include a first drive controller 110, a second drive controller 120, a third drive controller 130, a fourth drive controller 140, and output buffers 150A and 150B.

In an embodiment, transistors included in the i-th stage STi may be oxide semiconductor transistors. That is, a semiconductor layer (e.g., an active pattern) of the transistors may be formed of an oxide semiconductor.

The first drive controller 110 may control voltages of a first node N1 and a second node N2 in response to the scan start signal SSP. An output of an i-th carry signal CR(i) may be controlled based on the voltage of the first node N1 and the voltage of the second node N2. For example, the voltage of the first node N1 is a voltage for controlling the output of the i-th carry signal CR(i).

In an embodiment, in the display period, a voltage of a first drive node QN1 may be determined by the voltage of the first node N1, and a voltage of a second drive node QN2 may be determined by the voltage of the second node N2. Therefore, in the display period, outputs of an i-th scan signal SC(i), an (i+1)-th scan signal SC(i+1), an i-th sensing signal SS(i), and an (i+1)-th sensing signal SS(i+1) may be controlled. In other words, the first drive controller 110 may perform an operation for output control of the carry signal CR(i), the scan signals SC(i) and SC(i+1), and sensing signals SS(i) and SS(i+1).

In an embodiment, the first drive controller 110 may include a fourth transistor T4, a fifth transistor T5, a sixth transistor T6, and a ninth transistor T9 that controls the voltage of the first node N1, and third transistors T3-1 and T3-2, a seventh transistor T7, an eighth transistor T8, and twenty-third transistor T23 that control the voltage of the second node N2.

The fourth transistor T4 may be connected between the first power terminal V1 to which the first power VGH is applied and the first node N1. A gate electrode of the fourth transistor T4 may be connected to the first input terminal IN1 to which the scan start signal SSP is applied. The fourth transistor T4 may pre-charge the voltage of the first node N1 to the voltage of the first power VGH in response to the scan start signal SSP.

The fifth transistor T5 and the sixth transistor T6 may be connected in series between the first node N1 and the carry output terminal CR. A gate electrode of the fifth transistor T5 may be connected to the second carry control clock terminal CRCK2 to which the first carry control clock signal CLK1_CR is applied. A gate electrode of the sixth transistor T6 may be connected to the second node N2. The fifth transistor T5 and the sixth transistor T6 may hold the voltage of the first node N1.

The ninth transistor T9 may be connected between the first node N1 and the carry output terminal CR. A gate electrode of the ninth transistor T9 may be connected to the fourth input terminal IN4 receiving an (i+2)-th carry signal CR(i+2). The ninth transistor T9 may discharge the voltage charged in the first node N1. For example, the voltage of the first node N1 may be discharged in synchronization with a turning-on time point of the ninth transistor T9, that is, a rising time point of the (i+2)-th carry signal CR(i+2).

The third transistors T3-1 and T3-2 may be connected in series between the first carry control clock terminal CRCK1 to which the third carry control clock signal CLK3_CR is applied and the second node N2. In some embodiments of the disclosure, gate electrodes of the third transistors T3-1 and T3-2 may be connected to the first node N1.

The seventh transistor T7 may be connected between the second node N2 and the first power terminal V1. A gate electrode of the seventh transistor T7 may be connected to the first carry control clock terminal CRCK1 to which the third carry control clock signal CLK3_CR is applied.

The eighth transistor T8 may be connected between the second node N2 and the first power terminal V1. A gate electrode of the eighth transistor T8 may be connected to the third sensing clock terminal S_CK3 to which the third sensing clock signal S_CLK3 is applied.

The twenty-third transistor T23 may be connected between a common node between the third transistors T3-1 and T3-2 and the first power terminal V1. A gate electrode of the twenty-third transistor T23 may be connected to the second node N2.

The third transistor T-1 and T3-2, the seventh transistor T7, the eighth transistor T8, and the twenty-third transistor T23 may control the voltage of the second node N2 corresponding to the first carry control clock signal CLK1_CR.

The second drive controller 120 may control the voltage of the first drive node QN1 connected to the first node N1 based on the sensing on signal SEN_ON, the carry signal CR(i), the voltage of the first power VGH, the voltage of the first node N1, and the voltage of the sampling node SN, and may control the voltage of the second drive node QN2 based on the voltage of the sampling node SN and the sensing clock signals S_CLK, S_CLK2, and S_CLK3.

The second drive controller 120 may control the voltage of the first drive node QN1 and the voltage of the second drive node QN2 during the sensing period. During the sensing period, outputs of the scan signals SC(i) and SC(i+1) and the sense signals SS(i) and SS(i+1) may be controlled by the voltage of the first drive node QN1 and the voltage of the second drive node QN2.

In an embodiment, the second drive controller 120 may include sixteenth to nineteenth transistors T16-1 and T16-2 to T19 and twenty-second transistors T22 which control the voltage of the first drive node QN1, and a fourteenth transistor T14, a fifteenth transistor T15, and a twenty-fourth transistor T24 which control the voltage of the second drive node QN2. In addition, the second drive controller 120 may further include a twenty-fifth transistor T25 and a twenty-sixth transistor T26, which control a voltage between the first drive node QN1 and the second drive node QN2. The second drive controller may further include a third capacitor C3.

The sixteenth transistors T16-1 and T16-2 may be connected in series between the fourth input terminal IN4 to which the carry signal CR(i+2) is applied and the sampling node SN. Gate electrodes of the sixteenth transistors T16-1 and T16-2 may be connected to the second input terminal IN2 to which the sensing on signal SEN_ON is applied. In an embodiment, the subsequent carry signal may be the (i+2)-th carry signal CR(i+2). The sixteenth transistors T16-1 and T16-2 may charge the sampling node SN with the gate on voltage of the carry signal CR(i+2) in response to the sensing on signal SEN_ON. The sensing on signal SEN_ON may have the gate on voltage in synchronization with the subsequent carry signal CR(i+2).

The twenty-second transistor T22 may be connected to the first power terminal V1 and a common node between the sixteenth transistors T16-1 and T16-2. A gate electrode of the twenty-second transistor T22 may be connected to the sampling node SN. When the sampling node SN is charged, the twenty-second transistor T22 may supply the first power VGH to the common node between the sixteenth transistors T16-1 and T16-2 to stably maintain the gate on voltage charged in the sampling node SN.

The third capacitor C3 may be connected between the second power terminal V2 to which the second power VGL1 is applied and the sampling node SN. The gate on voltage charged in the sampling node SN in response to the sensing on signal SEN_ON during the display period may be maintained by the third capacitor C3.

The seventeenth transistor T17 and the eighteenth transistor T18 may be connected in series between the first sensing clock terminal S_CK1 to which the first sensing clock signal S_CLK1 is applied and the first drive node QN1. A common node between the seventeenth transistor T17 and the eighteenth transistor T18 may be defined as a third node N3.

A gate electrode of the seventeenth transistor T17 may be connected to the sampling node SN. A gate electrode of the eighteenth transistor T18 may be connected to the second sensing clock terminal S_CK2 to which the second sensing clock signal S_CLK2 is applied.

The nineteenth transistor T19 may be diode-connected between the third node N3 and the carry output terminal CR. That is, a gate electrode of the nineteenth transistor T19 may be connected to the carry output terminal CR. The nineteenth transistor T19 is connected in a diode form so that a current may flow from the carry output terminal CR to the third node N3.

The seventeenth to nineteenth transistors T17 to T19 may prevent or substantially reduce an unnecessary drain-source voltage increase of the seventeenth transistor T17 by holding the voltage of the third node N3 to the voltage of the first power VGH in response to the voltage of the first drive node QN1. Therefore, the output of the stable scan signals SC(i) and SC(i+1) is secured, and reliability of the display device may be improved (e.g., increased).

In addition, in some embodiments of the disclosure, the second drive controller 120 may charge the first drive node QN1 with a stable gate on voltage using the first sensing clock signal S_CLK1 as well as the voltage of the sampling node SN during the sensing period. For example, during the sensing period, the eighteenth transistor T18 may be turned on in synchronization with the second sensing clock signal S_CLK2, a conductive path through the eighteenth transistor T18 and the seventeenth transistor T17 may be further formed, and thus the voltage of the first drive node QN1 may be further charged.

In an embodiment, an operation of the second sensing clock signal S_CLK2 in the display period may vary according to an ambient temperature. When the display device operates at a high temperature, the second drive controller 120 need not assist the charge of the first drive node QN1 in the display period. Therefore, at a set or predetermined threshold temperature or higher, the second sensing clock signal S_CLK2 may maintain the gate off voltage during the display period. The second sensing clock signal S_CLK2 may have the gate on voltage in synchronization with the scan start signal SSP only when the display device is lower than the threshold temperature.

The second sensing clock signal S_CLK2 may be a global signal. Therefore, to assist a voltage charge of the first drive node QN1 in the stages corresponding to a plurality of pixel rows, the second sensing clock signal S_CLK2 may have the gate on voltage a plurality of times during the display period.

As described above, the scan driver according to the embodiments of the disclosure holds the voltage of the third node N3 at a set or predetermined voltage. Therefore, the unnecessary drain-source voltage increase of the seventeenth transistor T17 may be prevented or substantially reduced, and the gate on voltage may be stably charged in the first drive node QN1 during the display period and the sensing period. Therefore, reliability of the output of the scan signal SC(i) may be further improved (e.g., increased).

The fourteenth transistor T14 and the fifteenth transistor T15 may be connected in series between the second drive node QN2 and the third power terminal V3 to which the third power VGL2 is applied. A gate electrode of the fourteenth transistor T14 may be connected to the sampling node SN. A gate electrode of the fifteenth transistor T15 may be connected to the first drive node QN1. During the sensing period, the fourteenth transistor T14 and the fifteenth transistor T15 may be turned on and the voltage of the third power VGL2 may be applied to the second drive node QN2.

The twenty-fourth transistor T24 may be connected between a common node between the fourteenth transistor T14 and the fifteenth transistor T15 and the first power terminal V1. A gate electrode of the twenty-fourth transistor T24 may be connected to the second drive node QN2.

The twenty-fifth transistor T25 and the twenty-sixth transistor T26 may be connected in series between the first drive node QN1 and the carry output terminal CR. A gate electrode of the twenty-fifth transistor T25 may be connected to the third sensing clock terminal S_CK3 to which the third sensing clock signal S_CLK3 is applied, and a gate electrode of the twenty-sixth transistor T26 may be connected to the second drive node QN2.

The third drive controller 130 may output the carry signal CR(i) in response to the voltage of the first drive node QN1 and the voltage of the second drive node QN2. In some embodiments, the third drive controller 130 may be referred to as an output buffer for outputting the carry signal CR(i).

The third drive controller 130 may include a tenth transistor T10 and an eleventh transistor T11. The third drive controller 130 may further include a first capacitor C1 and a second capacitor C2.

The tenth transistor T10 may be connected between the second carry control clock terminal CRCK2 to which the first carry control clock signal CLK1_CR is applied and the carry output terminal CR. A gate electrode of the tenth transistor T10 may be connected to the first node N1. The tenth transistor T10 may supply the gate on voltage to the carry output terminal CR in response to the voltage of the first node N1. For example, the tenth transistor T10 may function as a pull-up buffer.

The eleventh transistor T11 may be connected between the carry output terminal CR and the second power terminal V2 to which the second power VGL1 is applied. A gate electrode of the eleventh transistor T11 may be connected to the second node N2. The eleventh transistor T11 may supply the gate off voltage to the carry output terminal CR in response to the voltage of the second node N2. For example, the eleventh transistor T11 may maintain the voltage of the carry output terminal CR to the gate off voltage level (e.g., the logic low level).

The first capacitor C1 may be connected between the first node N1 and the carry output terminal CR. The first capacitor C1 may function as a boosting capacitor. Therefore, the tenth transistor T10 may stably maintain a turn-on state for a set or predetermined period. The second capacitor C2 may be connected between the second node N2 and the second power terminal V2.

In an embodiment, since the i-th carry signal CR(i) is used as an input signal of another stage, the voltage of the second power VGL1 used as the gate off voltage of the carry signal may be lower than the voltage of the third power VGL2 for the output of the stable scan signal.

The fourth drive controller 140 may electrically connect the first node N1 and the first drive node QN1 to each other and electrically connect the second node N2 and the second drive node QN2 to each other in response to the display on signal DIS_ON. The display on signal DIS_ON may have the gate on voltage in the display period and may have the gate off voltage in the sensing period (e.g., a mobility sensing period).

In an embodiment, the output buffers 150A and 1506 may output the scan signals SC(i) and SC(i+1) and the sensing signals SS(i) and SS(i+1) according to an operation of the first drive controller 110 during the display period by the fourth drive controller 140. That is, during the display period, the second drive controller 120 does not affect the output of the output buffers 150A and 1506. Similarly, the output buffers 150A and 1506 may output the scan signals SC(i) and SC(i+1) and the sensing signals SS(i) and SS(i+1) according to an operation of the second drive controller 120 during the sensing period by the fourth drive controller 140. That is, during the sensing period, the first drive controller 110 does not affect the output of the output buffers 150A and 1506.

In an embodiment, the fourth drive controller 140 may include a twelfth transistor T12 and a thirteenth transistor T13.

The twelfth transistor T12 may be connected between the first node N1 and the first drive node QN1. A gate electrode of the twelfth transistor T12 may be connected to the third input terminal IN3 to which the display on signal DIS_ON is applied.

The thirteenth transistor T13 may be connected between the second node N2 and the second drive node QN2. A gate electrode of the thirteenth transistor T13 may be connected to the third input terminal IN3 to which the display on signal DIS_ON is applied.

The output buffers 150A and 1506 may output the scan signals SC(i) and SC(i+1) and the sensing signals SS(i) and SS(i+1) in response to the voltage of the first drive node QN1 and the voltage of the second drive node QN2.

The first output buffer 150A may output the i-th scan signal SC(i) and the i-th sensing signal SS(i). The first output buffer 150A may include a first transistor T1, a second transistor T2, a twentieth transistor T20, and a twenty-first transistor T21. The first output buffer 150A may further include a fourth capacitor C4 and a fifth capacitor C5.

The first transistor T1 may be connected between the first scan control clock terminal SCCK1 to which the third scan control clock signal CLK3_SC is applied and the first output terminal OUT1 that outputs the i-th scan signal SC(i). A gate electrode of the first transistor T1 may be connected to the first drive node QN1. The first transistor T1 may supply the gate on voltage to the first output terminal OUT1 in response to the voltage of the first drive node QN1.

The second transistor T2 may be connected between the first output terminal OUT1 and the third power terminal V3 to which the third power VGL2 is applied. A the gate electrode of the second transistor T2 may be connected to the second drive node QN2. The second transistor T2 may supply the gate off voltage to the first output terminal OUT1 in response to the voltage of the second drive node QN2.

The twentieth transistor T20 may be connected between the first sensing control clock terminal SSCK1 to which the third sensing control clock signal CLK3_SS is applied and the second output terminal OUT2 that outputs the i-th sensing signal SS(i). A gate electrode of the twentieth transistor T20 may be connected to the first drive node QN1. The twentieth transistor T20 may supply the gate on voltage to the second output terminal OUT2 in response to the voltage of the first drive node QN1. For example, the twentieth transistor T20 may function as a pull-up buffer.

The twenty-first transistor T21 may be connected between the second output terminal OUT2 and the third power terminal V3 to which the third power VGL2 is applied. A gate electrode of the twenty-first transistor T21 may be connected to the second drive node QN2. The twenty-first transistor T21 may supply the gate off voltage to the second output terminal OUT2 in response to the voltage of the second drive node QN2.

The fourth capacitor C4 is connected between the first drive node QN1 and the second output terminal OUT2 and the fifth capacitor C5 is connected between the first drive node QN1 and the first output terminal OUT1. Since the fourth capacitor C4 and the fifth capacitor C5 are provided, the stage STi may be more robust against a threshold voltage negative condition.

The second output buffer 1506 may output the (i+1)-th scan signal SC(i+1) and the (i+1)-th sensing signal SS(i+1). The second output buffer 1506 may include twenty-seventh to thirtieth transistors T27 to T30. The second output buffer 1506 may further include a sixth capacitor C6 and a seventh capacitor C7.

The twenty-seventh transistor T27 may be connected to the second scan control clock terminal SCCK2 to which the fourth scan control clock signal CLK4_SC is applied and the third output terminal OUT3 that outputs (i+1)-th scan signal SC(i+1). A gate electrode of the twenty-seventh transistor T27 may be connected to the first drive node QN1. The twenty-seventh transistor T27 may supply the gate on voltage to the third output terminal OUT3 in response to the voltage of the first drive node QN1.

The twenty-eighth transistor T28 may be connected between the third output terminal OUT3 and the third power terminal V3 to which the third power VGL2 is applied. A gate electrode of the twenty-eighth transistor T28 may be connected to the second drive node QN2. The twenty-eighth transistor T28 may supply the gate off voltage to the third output terminal OUT3 in response to the voltage of the second drive node QN2.

The twenty-ninth transistor T29 may be connected between the second sensing control clock terminal SSCK2 to which the fourth sensing control clock signal CLK4_SS is applied and the fourth output terminal OUT4 that outputs the (i+1)-th sensing signal SS(i+1). A gate electrode of the twenty-ninth transistor T29 may be connected to the first drive node QN1. The twenty-ninth transistor T29 may supply the gate on voltage to the fourth output terminal OUT4 in response to the voltage of the first drive node QN1. For example, the twenty-ninth transistor T29 may function as a pull-up buffer.

The thirtieth transistor T30 may be connected between the fourth output terminal OUT4 and the third power terminal V3 to which the third power VGL2 is applied. A gate electrode of the thirtieth transistor T30 may be connected to the second drive node QN2. The thirtieth transistor T30 may supply the gate off voltage to the fourth output terminal OUT4 in response to the voltage of the second drive node QN2.

The sixth capacitor C6 is connected between the first drive node QN1 and the fourth output terminal OUT4, and the seventh capacitor C7 is connected between the first drive node QN1 and the third output terminal OUT3. Since the sixth capacitor C6 and the seventh capacitor C are provided, the stage STi may be more robust against the threshold voltage negative condition.

In some embodiments of the disclosure, the first to fourth drive controllers 110 to 140 may be shared with respect to the i-th first scan line and the i-th second scan line, and the (i+1)-th first scan line and the (i+1)-th second scan line. That is, the first to fourth drive controllers 110 to 140 are provided as a common circuit for a plurality of first scan lines and a plurality of second scan lines. Since the plurality of first scan lines and the plurality of second scan lines share the drive controllers 110 to 140, a dead space by the drive controllers 110 to 140 may be minimized.

Although FIG. 4 shows an embodiment in which each of the output buffers 150A and 150B includes the capacitors C4 to C7, embodiments of the disclosure are not limited thereto. For example, in some embodiments of the disclosure, the capacitors C4 to C7 of each of the output buffers 150A and 150B may be omitted.

Figure 5:
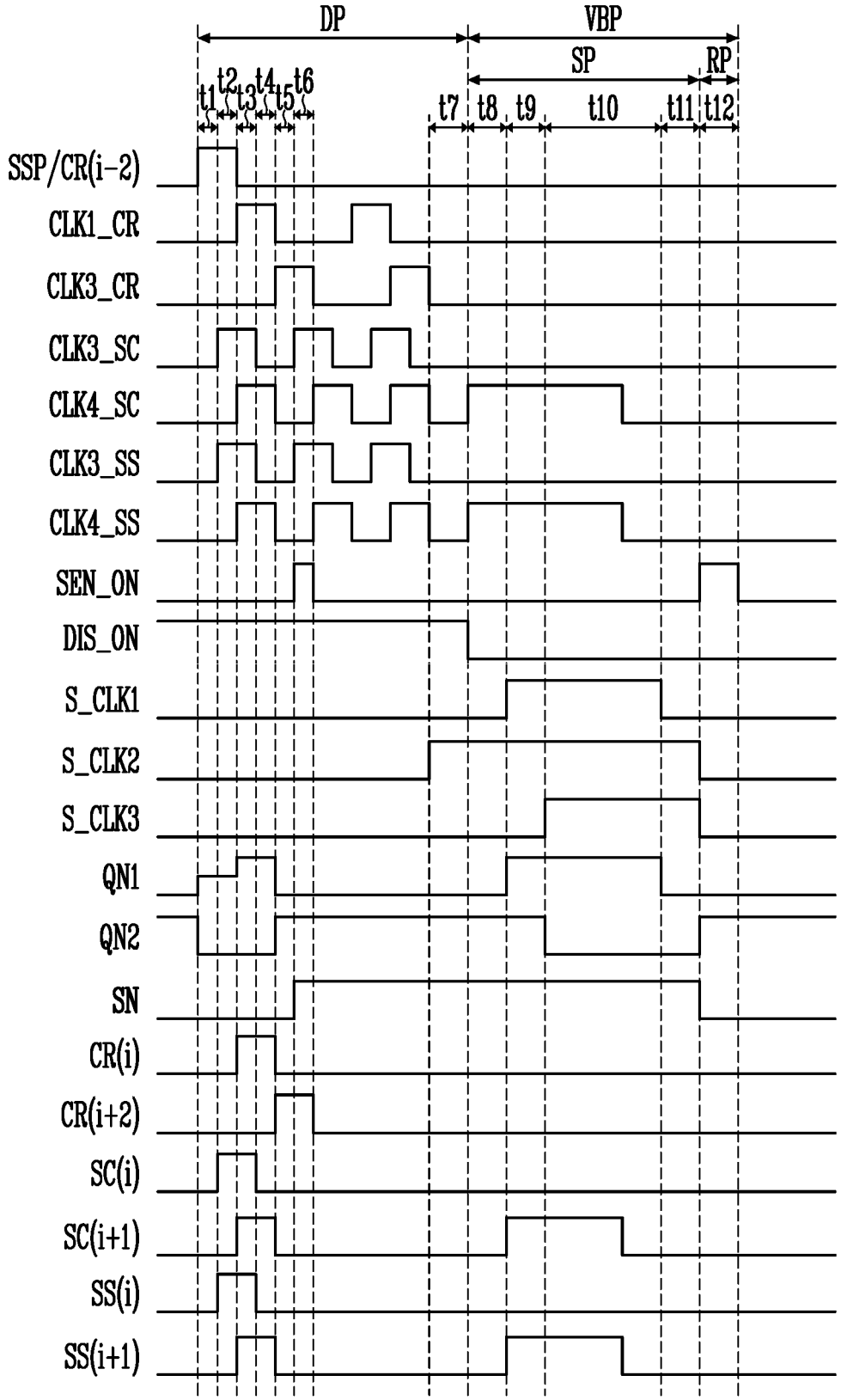
FIG. 5 is a timing diagram illustrating an example of an operation of the stage of FIG. 4.

FIG. 5 is a timing diagram illustrating an example of an operation of the stage of FIG. 4. In FIG. 5, an operation of the i-th stage STi will be mainly described. In addition, a position, a width, a height, and the like of a waveform shown in FIG. 5 are merely examples, and the disclosure is not limited thereto.

Referring to FIGS. 1 to 5, one frame period may include a display period DP and a vertical blank period VBP.

In the display period DP, the scan signals SC(i) and SC(i+1) may be sequentially provided to the pixel lines. In addition, during the display period DP, the sensing signals SS(i) and SS(i+1) may be provided to pixel lines.

In the display period DP, the sensing on signal SEN_ON may be supplied to at least one stage (e.g., in the present embodiment, the i-th stage STi) selected from among the plurality of stages. Only the stage receiving the sensing on signal SEN_ON may output the scan signals SC(i) and SC(i+1) and the sensing signals SS(i) and SS(i+1) in response to the carry control clock signals CLK3_SC and CLK4_SC the sensing control clock signals CLK3_SS and CLK4_SS in a subsequent sensing period SP. During the sensing period SP, sensing for pixels receiving the scan signals SC(i) and SC(i+1) and the sensing signals SS(i) and SS(i+1) output from the selected at least one stage may be performed.

In the display period DP, the display on signal DIS_ON may have the gate on voltage, and the second sensing clock signal S_CLK2 and the third sensing clock signal S_CLK3 may have a gate off signal. Therefore, during the display period DP, the twelfth transistor T12 and the thirteenth transistor T13 maintain the turn-on state and the eighth transistor T8, the eighteenth transistor T18, and the twenty-fifth transistor T25 maintain the turn-off state.

In a first period t1, the scan start signal SSP or the previous carry signal CR(i-2) is applied to the first input terminal IN1. Then, the fourth transistor T4 is turned on, and the first power terminal V1 and the first node N1 are electrically connected to each other. Therefore, the voltage of the first node N1 and the voltage of the first drive node QN1 may be pre-charged.

As the voltages of the first node N1 and the first drive node QN1 increase, the third transistors T3-1 and T3-2, the tenth transistor T10, the first transistor T1, the twentieth transistor T20, the twenty-seventh transistor T27, the twenty-ninth transistor T29, and the fifteenth transistor T15 are turned on.

When the third transistors T3-1 and T3-2 are turned on, the first carry control clock terminal CRCK1 and the second node N2 are electrically connected to each other, and the third carry control clock signal CLK3_CR is supplied to the second node N2. Since the third carry control clock signal CLK3_CR maintains the low level during the first period t1, the voltages of the second node N2 and the second drive node QN2 are set to the low level, and transistors of which gate electrodes are connected to the second node N2 and the second drive node QN2 are set to the turn-off state.

When the tenth transistor T10 is turned on, the second carry control clock terminal CRCK2 and the carry output terminal CR are electrically connected to each other, and the first carry control clock signal CLK1_CR is output to the carry output terminal CR. Since the first carry control clock signal CLK1_CR maintains the low level during the first period t1, the clock signal CR(i) of the low level is output to the carry output terminal CR.

The first transistor T1, the twentieth transistor T20, the twenty-seventh transistor T27, and the twenty-ninth transistor T29 are turned on during the first period t1; however, since the third scan control clock signal CLK3_SC, the third sensing control clock signal CLK3_SS, the fourth scan control clock signal CLK4_SC, and the fourth sensing control clock signal CLK4_SS have the gate off voltage, the scan signals SC(i) and SC(i+1) and the sensing signals SS(i) and SS(i+1) have the low levels.

In addition, the fifteenth transistor T15 is turned on during the first period t1; however, since the fourteenth transistor T14 and the twenty-fourth transistor T24 are the turn-off state, the voltage of the second drive node QN2 is not affected.

In a second period t2, the third scan control clock signal CLK3_SC and the third sensing control clock signal CLK3_SS are further supplied. Therefore, the i-th scan signal SC(i) and the i-th sensing signal SS(i) of the high level are output.

In a third period t3, the supply of the scan start signal SSP or the previous carry signal CR(i-2) is stopped. In addition, in the third period t3, the first carry control clock signal CLK1_CR, the fourth scan control clock signal CLK4_SC, and the fourth sensing control clock signal CLK4_SS are further supplied. When the first carry control clock signal CLK1_CR has the gate on voltage, the voltages of the first node N1 and the first drive node QN1 may be boosted by the first capacitor C1.

During the third period t3, the fourth transistor T4 is turned off and the fifth transistor T5 is turned on. Since the sixth transistor T6 maintains the turn-off state, even though the fifth transistor T5 is turned on, the voltage of the first node N1 is not affected.

During the third period t3, the first carry control clock signal CLK1_CR of the high level is output as the carry signal CR(i) through the tenth transistor T10 of the turn-on state. When the carry signal CR(i) of the high level is turned on, the nineteenth transistor T19 is diode-connected. Therefore, the voltage of the third node N3 is held to a set or predetermined voltage, the unnecessary drain-source voltage increase of the seventeenth transistor T17 may be prevented or substantially reduced, and the gate on voltage may be stably charged to the first drive node QN1. In addition, during the third period t3, the (i+1)-th scan signal SC(i+1) and the (i+1)-th sensing signal SS(i+1) is further output in response to the fourth scan control clock signal CLK4_SC and the fourth sensing control clock signal CLK4_SS.

In a fourth period t4, the supply of the third scan control clock signal CLK3_SC and the third sensing control clock signal CLK3_SS is stopped. Therefore, the i-th scan signal SC(i) and the i-th sensing signal SS(i) of the low level out output.

In a fifth period t5, the supply of the first carry control clock signal CLK1_CR, the fourth scan control clock signal CLK4_SC, and the fourth sensing control clock signal CLK4_SS is stopped, and the third carry control clock signal CLK3_CR and the subsequent carry signal CR(i+2) are supplied. Therefore, the fifth transistor T5 is turned off, and the seventh transistor T7 and the ninth transistor T9 are turned on.

When the fifth transistor T5 is turned off and the ninth transistor T9 is turned on, the voltages of the first node N1 and the first drive node QN1 are discharged. Then, the third transistor T3-1 and T3-2, the tenth transistor T10, the first transistor T1, the twentieth transistor T20, the twenty-seventh transistor T27, the twenty-ninth transistor T29, and the fifteenth transistor T15 of which the gate electrodes are connected to the first node N1 and the first drive node QN1 are turned off.

When the seventh transistor T7 is turned on, the first power VGH is supplied to the second node N2, and thus the voltages of the second node N2 and the second drive node QN2 may be pre-charged. Then, the eleventh transistor T11, the second transistor T2, the twenty-first transistor T21, the twenty-eighth transistor T28, the thirtieth transistor T30, the twenty-third transistor T23, and the twenty-fourth transistor T24 of which the gate electrodes are connected to the second node N2 and the second drive node QN2 are turned on.

When the eleventh transistor T11, the second transistor T2, the twenty-first transistor T21, the twenty-eighth transistor T28, and the thirtieth transistor T30 are turned on, the second power VGL1 and the third power VGL2 are output to the carry signal CR(i), the scan signals SC(i) and SC(i+1), and the sensing signals SS(i) and SS(i+1). Therefore, the carry signal CR(i), the scan signals SC(i) and SC(i+1), and the sensing signals SS(i) and SS(i+1) are set to the low level. When the carry signal CR(i) is set to the low level, the nineteenth transistor T19 is set to turn off.

In a sixth period t6, the sensing on signal SEN_ON is further supplied. Then, the sixteenth transistors T16-1 and T16-2 are turned on, and the gate on voltage of the subsequent carry signal CR(i+2) is supplied to the sampling node SN. Therefore, the sampling node SN may be charged with the gate on voltage.

The stage STi receiving the sensing on signal SEN_ON may output the scan signal SC(i) and/or SC(i+1) and the sensing signal SS(i) and/or SS(i+1) in a subsequent vertical blank period VBP. That is, when the sensing clock signals S_CLK1, S_CLK2, and S_CLK3 have the gate on voltage and the display on signal DIS_ON has the gate off voltage during the vertical blank period VBP, the voltage of the first drive node QN1 may be charged in correspondence with the charge voltage of the sensing node SN.

Although the third scan control clock signal CLK3_SS and the third sensing control clock signal CLK3_SS are supplied during the sixth period t6, since the voltages of the first node N1 and the first drive node QN1 are maintained as the low level and the transistors of which the gate electrodes are connected to the first drive node QN1 maintain the turn-off state, the scan signal SC(i) and the sensing signal SS(i) are maintained as the low level.

In a seventh period t7, the second sensing clock signal S_CLK2 is supplied. Then, the eighteenth transistor T18 is turned on. In the disclosure, the second sensing clock signal S_CLK1 is supplied first before the sensing period SP to turn on the eighteenth transistor T18. Therefore, a delay of the charge of the first drive node QN1 in the sensing period SP may be prevented or substantially reduced.

The vertical blank period VBP may include the sensing period SP. However, this is an example, and a reset period RP may be included in the display period DP. In an embodiment, the sensing period SP may include a first sensing period during which the mobility of the driving transistor M1 and the threshold voltage are sensed, and a second sensing period during which the current characteristic of the light emitting element LED is sensed. In addition, the vertical blank period VBP may further include the reset period RP.

In the sensing period SP, the i-th stage STi may output the scan signal SC(i) and/or SC(i+1) in synchronization with the scan control clock signal CLK3_SC and/or CLK4_SC applied to the scan control clock terminal SCCK1 and/or SCCK2. In addition, in the sensing period SP, the i-th stage STi may output the sensing signal SS(i) and/or SS(i+1) in synchronization with the sensing control clock signal CLK3_SS and/or CLK4_SS applied to the sensing control clock terminal SSCK1 and/or SSCK2. FIG. 5 shows an embodiment in which the fourth scan control clock signal CLK4_SC is supplied to the second scan control clock terminal SCCK2 and the fourth sensing control clock signal CLK4_SS is supplied to the second sensing control clock terminal SSCK2 during the sensing period SP.

In the sensing period SP, the display on signal DIS_ON may have the gate off voltage and the first to third sensing clock signals S_CLK1, S_CLK2, and S_CLK3 may have the gate on signal. Therefore, during the sensing period SP, the twelfth transistor T12 and the thirteenth transistor T13 may maintain the turn-off state and the eighth transistor T8, the eighteenth transistor T18, and the twenty-fifth transistor T25 may maintain the turn-on state.

In an eighth period t8, the fourth scan control clock signal CLK4_SC is supplied to the second scan control clock terminal SCCK2 and the fourth sensing control clock signal CLK4_SS is supplied to the second sensing control clock terminal SSCK2. In the disclosure, the fourth scan control clock signal CLK4_SC and the fourth sensing control clock signal CLK4_SS are supplied first before the first sensing clock signal S_CLK1 and the third sensing clock signal S_CLK3 are supplied. Therefore, an output delay of the scan signal SC(i+1) and the sensing signal SS(i+1) may be prevented or substantially reduced.

In a ninth period t9, the first sensing clock signal S_CLK1 is supplied. Since the sensing node SN of the corresponding stage STi selected during the display period DP is charged with the gate on voltage, the seventeenth transistor T17 maintains the turn-on state. Therefore, the gate on voltage of the first sensing clock signal S_CLK1 may be transferred to the first drive node QN1 via the seventeenth transistor T17 and the eighteenth transistor T18.

When the first drive node QN1 is set to the gate on voltage, the first transistor T1, the twentieth transistor T20, the twenty-seventh transistor T27, and the twenty-ninth transistor T29 are turned on. Then, the gate on voltage of the fourth scan control clock signal CLK4_SC is output as the (i+1)-th scan signal SC(i+1) via the turned on twenty-seventh transistor T27. In addition, the gate on voltage of the fourth sensing control clock signal CLK4_SS is output as the (i+1)-th sensing signal SS(i+1) via the turned on twenty-ninth transistor T29. The (i+1)-th scan signal SC(i+1) and the (i+1)-th sensing signal SS(i+1) are maintained as the high level while the fourth scan control clock signal CLK4_SC and the fourth sensing control clock signal CLK4_SS have the gate on voltage.

In a tenth period t10, the third sensing clock signal S_CLK3 is further supplied. Then, the eighth transistor T8 and the twenty-fifth transistor T25 may be turned on.

Since the sampling node SN is charged with the gate on voltage during the sensing period SP, the fourteenth transistor T14 maintains the turn-on state, and since the first drive node QN1 is charged with the gate on voltage, the fifteenth transistor T15 maintains the turn-on state. Then, the third power VGL2 may be transferred to the second drive node QB2 via the fifteenth transistor T15 and the fourteenth transistor T14, and the second drive node QB2 may stably maintain the low level during the sensing period SP.

In an eleventh period t11, the supply of the first sensing clock signal S_CLK1 is stopped. Then, the gate off voltage of the first sensing clock signal S CLK1 may be transferred to the first drive node QN1 via the seventeenth transistor T17 and the eighteenth transistor T18. Therefore, the first drive node QN1 is initialized to the gate off voltage.

In a twelfth period t12, that is, in the reset period RP, the sensing on signal SEN_ON may have the gate on voltage. At this time, since the subsequent carry signal CR(i+2) has the gate off voltage, the voltage of the sampling node SN may be reset to the gate off voltage through the turned on sixteenth transistors T16-1 and T16-2.

Figure 6:
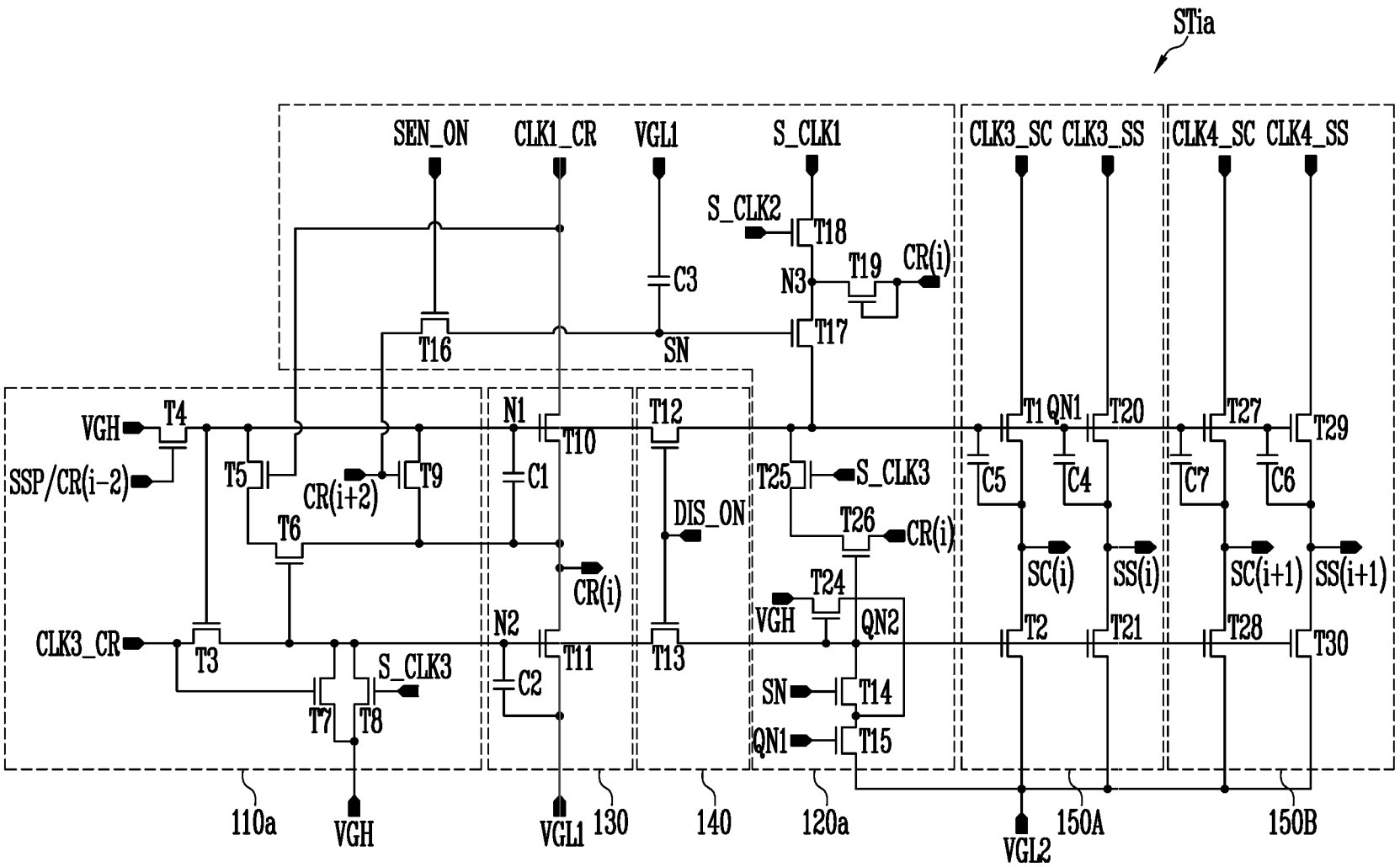
FIG. 6 is a circuit diagram illustrating a second embodiment of the stage included in the scan driver of FIG. 3.

FIG. 6 is a circuit diagram illustrating a second embodiment of the stage included in the scan driver of FIG. 3.

In FIG. 6, the same reference numerals are used for the components described with reference to FIG. 4, and a repetitive description of these components will be omitted. In addition, a stage STia of FIG. 6 may have substantially the same or similar configuration as the stage STi of FIG. 4, except for the first drive controller 110 and the second drive controller 120.

Referring to FIGS. 3, 4, and 6, the i-th stage STia may include a first drive controller 110*a*, a second drive controller 120*a*, the third drive controller 130, the fourth drive controller 140, and the output buffers 150A and 1506.

In the second embodiment of the disclosure, the first drive controller 110*a* includes one third transistor T3, and the twenty-third transistor T23 is omitted in comparison with the first embodiment. Similarly, the second drive controller 120*a* includes one sixteenth transistor T16, and the twenty-second transistor T22 is omitted in comparison with the first embodiment.

Since a method of driving the stage STia shown in FIG. 6 is the same as that shown in FIG. 5, a repetitive detailed description thereof will be omitted.

Figure 7:
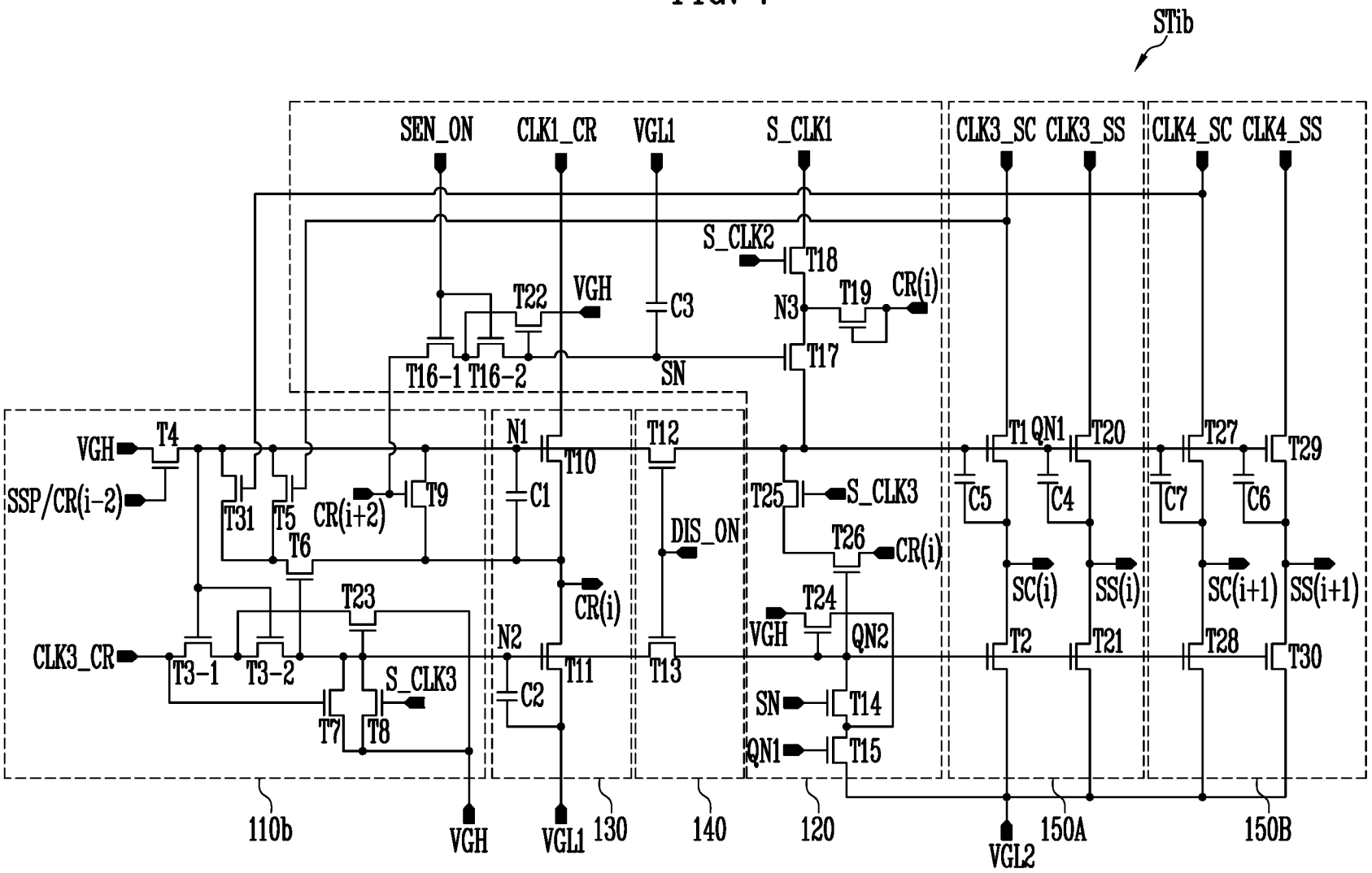
FIG. 7 is a circuit diagram illustrating a third embodiment of the stage included in the scan driver of FIG. 3.

FIG. 7 is a circuit diagram illustrating a third embodiment of the stage included in the scan driver of FIG. 3.

In FIG. 7, the same reference numerals are used for the components described with reference to FIG. 4, and a repetitive description of these components will be omitted. In addition, a stage STib of FIG. 7 may have substantially the same or similar configuration as the stage STi of FIG. 4, except for a configuration of a first drive controller 110*b*.

Referring to FIGS. 3, 4, and 7, the i-th stage STib may include the first drive controller 110*b*, the second drive controller 120, the third drive controller 130, the fourth drive controller 140, and the output buffers 150A and 150B.

In the third embodiment of the disclosure, the first drive controller 110*b* may further include a thirty-first transistor T31. The thirty-first transistor T31 may be connected between a common node between the fifth transistor T5 and the sixth transistor T6 and the first node N1. A gate electrode of the thirty-first transistor T31 may be connected to the second scan control clock terminal SCCK2 receiving the fourth scan control clock signal CLK4_SC.

The fifth transistor T5 may be connected to the first scan control clock terminal SCCK1 receiving the third scan control clock signal CLK3_SC, in comparison with the first embodiment.

The fifth transistor T5 and the thirty-first transistor T31 may be turned on when the third scan control clock signal CLK3_SC or the fourth scan control clock signal CLK4_SC is supplied during the sensing period SP. Since the sixth transistor T6 maintains the turn-on state during the sensing period SP, when the fifth transistor T5 or the thirty-first transistor T31 is turned on, the first node N1 may stably maintain the low level.

Since a method of driving the stage STib shown in FIG. 7 is the same as that shown in FIG. 5, a repetitive detailed description thereof will be omitted.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ.

Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Although the disclosure has been described with reference to the embodiments thereof, it will be understood by those skilled in the art that various changes and modifications of the disclosure may be made without departing from the spirit and scope of the disclosure as defined by the following claims and equivalents thereof.

What is claimed is:

1. A scan driver comprising:

a plurality of stages configured to output a scan signal and a sensing signal, wherein an i-th (where i is an odd number) stage comprises:

a common circuit configured to control voltages of a first node and a second node in response to a previous carry signal, a first carry control clock signal, and a second carry control clock signal, to control a voltage of a sampling node in response to a sensing on signal and a subsequent carry signal, and to control voltages of a first drive node and a second drive node based on the voltages of the first node, the second node, the sampling node, and a sensing clock signal;

a first output buffer configured to output the scan signal and the sensing signal to an i-th pixel row in response to the voltages of the first drive node and the second drive node; and a second output buffer configured to output the scan signal and the sensing signal to an (i+1)-th pixel row in response to the voltages of the first drive node and the second drive node.

2. The scan driver according to claim 1, wherein the common circuit comprises:

a first drive controller configured to control the voltages of the first node and the second node in response to the previous carry signal, the first carry control clock signal, and the second carry control clock signal;

a second drive controller configured to control the voltage of the sampling node in response to the sensing on signal and the subsequent carry signal and to control the voltages of the first drive node and the second drive node in response to the voltages of the first node, the second node, the sampling node, and the sensing clock signal;

a third drive controller configured to output a carry signal in response to the voltage of the first node and the voltage of the second node; and a fourth drive controller configured to electrically connect the first node and the first drive node to each other and electrically connect the second node and the second drive node to each other in response to a display on signal.

3. The scan driver according to claim 2, wherein gate on voltage periods of the first carry control clock signal and the second carry control clock signal do not overlap, and a gate on voltage period of the sensing on signal overlaps a portion of the gate on voltage period of the second carry control clock signal.

4. The scan driver according to claim 3, wherein the first carry control clock signal is applied prior to the second carry control clock signal.

5. The scan driver according to claim 2, wherein the sensing on signal is supplied to at least one stage of the stages in a display period, and wherein the at least one stage is configured to output the scan signal and the sensing signal in response to a scan control clock signal and a sensing control clock signal during a vertical blank period after the display period.

6. The scan driver according to claim 5, wherein the sensing scan control clock signal and the sensing control clock signal are supplied to at least one of the first output buffer and the second output buffer in the vertical blank period.

7. The scan driver according to claim 2, wherein the first drive controller comprises:

a fourth transistor connected between a first power terminal to which a first power is supplied and the first node, the fourth transistor having a gate electrode configured to receive the previous carry signal or a scan start signal;

a fifth transistor and a sixth transistor connected in series between the first node and a carry output terminal configured to output the carry signal, the fifth transistor having a gate electrode connected to a second carry control clock terminal to which the first carry control clock signal is applied and the sixth transistor having a gate electrode connected to the second node;

a ninth transistor connected between the first node and the carry output terminal, the ninth transistor having a gate electrode configured to receive the subsequent carry signal;

a third transistor connected between a first carry control clock terminal to which the second carry control clock signal is applied and the second node, the third transistor having a gate electrode connected to the first node; and a seventh transistor connected between the first power terminal and the second node, the seventh transistor having a gate electrode connected to the first carry control clock terminal.

8. The scan driver according to claim 7, wherein the third transistor comprises first and second sub transistors connected in series between the first carry control clock terminal and the second node, the first and second sub transistors having gate electrodes connected to the first node, and wherein the first drive controller further comprises:

a twenty-third transistor connected between a common node of the first and second sub transistors and the first power terminal, the twenty-third transistor having a gate electrode connected to the second node.

9. The scan driver according to claim 2, wherein the second drive controller comprises:

a sixteenth transistor connected between an input terminal to which the subsequent carry signal is applied and the sampling node, the sixteenth transistor having a gate electrode configured to receive the sensing on signal;

a seventeenth transistor connected between a third node and the first drive node, the seventeenth transistor having a gate electrode connected to a sensing node;

an eighteenth transistor connected between a first sensing clock terminal to which a first sensing clock signal is applied and the third node, the eighteenth transistor having a gate electrode configured to receive a second sensing clock signal; and a nineteenth transistor diode-connected between a carry output terminal from which the carry signal is output and the third node.

10. The scan driver according to claim 9, wherein the sixteenth transistor comprises first and second sub transistors connected in series between the input terminal to which the subsequent carry signal is applied and the sampling node, the first and second sub transistors having gate electrodes configured to receive the sensing on signal, and wherein the second drive controller further comprises:

a twenty-second transistor connected between a common node of the first and second sub transistors and a first power terminal, the twenty-second transistor having a gate electrode connected to the sampling node.

11. The scan driver according to claim 10, wherein the second drive controller further comprises:

twenty-fifth and twenty-sixth transistors connected in series between the carry output terminal and the first drive node, the twenty-fifth and twenty-sixth transistors having gate electrodes connected to a third sensing clock terminal to which a third sensing clock signal is applied and the second drive node, respectively.

12. The scan driver according to claim 11, wherein the third drive controller comprises:

a tenth transistor connected between a second carry control clock terminal to which the first carry control clock signal is applied and a carry output terminal from which the carry signal is output, the tenth transistor having a gate electrode connected to the first node; and an eleventh transistor connected between the carry output terminal and a second power terminal to which second power is applied, the eleventh transistor having a gate electrode connected to the second node.

13. The scan driver according to claim 9, wherein the second drive controller comprises:

fourteenth and fifteenth transistors connected in series between a third power terminal to which a third power is applied and the second drive node, the fourteenth and fifteenth transistors having gate electrodes connected to the sampling node and the first drive node, respectively; and a twenty-fourth transistor connected between a common node of the fourteenth and fifteenth transistors and a first power terminal to which first power is supplied, the twenty-fourth transistor having a gate electrode connected to the second drive node.

14. The scan driver according to claim 2, wherein the fourth drive controller comprises:

a twelfth transistor connected between the first node and the first drive node, the twelfth transistor having a gate electrode configured to receive the display on signal; and a thirteenth transistor connected between the second node and the second drive node, the thirteenth transistor having a gate electrode configured to receive the display on signal.

15. The scan driver according to claim 2, wherein the first output buffer comprises:

a first transistor connected between a first scan control clock terminal to which a first scan control clock signal is applied and a first output terminal configured to output the scan signal, the first transistor having a gate electrode connected to the first drive node;

a second transistor connected between a third power terminal to which a third power is applied and the first output terminal, the second transistor having a gate electrode connected to the second drive node;

a twentieth transistor connected between a first sensing control clock terminal to which a first sensing control clock signal is applied and a second output terminal configured to output the sensing signal, the twentieth transistor having a gate electrode connected to the first drive node; and a twenty-first transistor connected between the third power terminal and the second output terminal, the twenty-first transistor having a gate electrode connected to the second drive node.

16. The scan driver according to claim 2, wherein the second output buffer comprises:

a twenty-seventh transistor connected between a second scan control clock terminal to which a second scan control clock signal is applied and a third output terminal configured to output the scan signal, the twenty-seventh transistor having a gate electrode connected to the first drive node;

a twenty-eighth transistor connected between a third power terminal to which a third power is applied and the third output terminal, the twenty-eighth transistor having a gate electrode connected to the second drive node;

a twenty-ninth transistor connected between a second sensing control clock terminal to which a second sensing control clock signal is applied and a fourth output terminal outputting the sensing signal, the twenty-ninth transistor having a gate electrode connected to the first drive node; and a thirtieth transistor connected between the third power terminal and the fourth output terminal, the thirtieth transistor having a gate electrode connected to the second drive node.

17. The scan driver according to claim 2, wherein the first drive controller comprises:

a fourth transistor connected between a first power terminal to which a first power is applied and the first node, the fourth transistor having a gate electrode configured to receive the previous carry signal or a scan start signal;

fifth and sixth transistors connected in series between the first node and a carry output terminal configured to output the carry signal, the fifth and sixth transistors having gate electrodes connected to a first scan control clock terminal to which a first scan control clock signal is applied and the second node, respectively;

a thirty-first transistor connected between the first node and a common node of the fifth and sixth transistors, the thirty-first transistor having a gate electrode connected to a second scan control clock terminal to which a second scan control clock signal is applied;

a ninth transistor connected between the first node and the carry output terminal, the ninth transistor having a gate electrode configured to receive the subsequent carry signal;

a third transistor connected between a first carry control clock terminal to which a second carry control clock signal is applied and the second node, the third transistor having a gate electrode connected to the first node; and a seventh transistor connected between the first power terminal and the second node, the seventh transistor having a gate electrode connected to the first carry control clock terminal.

18. A display device comprising:

a plurality of pixels connected to first and second scan lines and data lines, respectively;

a scan driver comprising a plurality of stages to supply a scan signal and a sensing signal to each of the first and second scan lines; and a data driver configured to supply a data signal to the data lines, wherein an i-th (where i is an odd number) stage comprises:

a common circuit configured to control voltages of a first node and a second node in response to a previous carry signal, a first carry control clock signal, and a second carry control clock signal, to control a voltage of a sampling node in response to a sensing on signal and a subsequent carry signal, and to control voltages of a first drive node and a second drive node based on the voltages of the first node, the second node, and the sampling node, and a sensing clock signal;

a first output buffer configured to output the scan signal and the sensing signal to an i-th pixel row in response to the voltages of the first drive node and the second drive node; and a second output buffer configured to output the scan signal and the sensing signal to an (i+1)-th pixel row in response to the voltages of the first drive node and the second drive node.

19. The display device according to claim 18, wherein the common circuit comprises:

a first drive controller configured to control the voltages of the first node and the second node in response to the previous carry signal, the first carry control clock signal, and the second carry control clock signal;

a second drive controller configured to control the voltage of the sampling node in response to the sensing on signal and the subsequent carry signal and control the voltages of the first drive node and the second drive node in response to the voltages of the first node, the second node, and the sampling node, and the sensing clock signal;

a third drive controller configured to output a carry signal in response to the voltage of the first node and the voltage of the second node; and a fourth drive controller configured to electrically connect the first node and the first drive node to each other and electrically connect the second node and the second drive node to each other in response to a display on signal.

20. The display device according to claim 19, wherein gate on voltage periods of the first carry control clock signal and the second carry control clock signal do not overlap, and wherein a gate on voltage period of the sensing on signal overlaps a portion of the gate on voltage period of the second carry control clock signal.

* * * * *